US006343963B1

(12) United States Patent
Bronk

(10) Patent No.: US 6,343,963 B1
(45) Date of Patent: Feb. 5, 2002

(54) ROTATABLE AND LOCKABLE ELECTRICAL CONNECTOR

(75) Inventor: Arthur H. Bronk, San Jose, CA (US)

(73) Assignee: Cableco Technologies Corporation, San Jose, CA (US)

( * ) Notice: Subject to any disclaimer, the term of this patent is extended or adjusted under 35 U.S.C. 154(b) by 0 days.

(21) Appl. No.: 09/522,942

(22) Filed: Mar. 10, 2000

(51) Int. Cl.[7] ..... H01R 4/50

(52) U.S. Cl. ..... 439/805; 439/8; 439/11; 439/13; 439/18; 439/23; 439/28

(58) Field of Search ..... 439/805, 11, 13, 439/18, 28, 23, 8, 20, 723; 403/279, 281; 24/265 A, 265 EC, 703.1, 704.1, 265 R

(56) References Cited

U.S. PATENT DOCUMENTS

| | | | | | |
|---|---|---|---|---|---|
| 1,039,542 | A | | 9/1912 | Kennington | |
| 1,146,881 | A | | 7/1915 | Jeffries | |
| 1,871,839 | A | | 8/1932 | Carter | |
| 2,246,901 | A | * | 6/1941 | Schwarzmann | 200/19 |
| 2,414,143 | A | * | 1/1947 | Dunning | 439/723 |
| 2,930,836 | A | * | 3/1960 | Floyd | 439/723 |
| 2,931,009 | A | | 3/1960 | Dutton et al. | 339/268 |
| 2,959,764 | A | | 11/1960 | Barr | 339/268 |
| 3,474,399 | A | | 10/1969 | Teagno | 339/276 |
| 3,899,238 | A | * | 8/1975 | Vinje | 439/777 |
| 3,957,331 | A | * | 5/1976 | Tantillo et al. | 439/20 |
| 4,003,616 | A | * | 1/1977 | Springer | 439/23 |
| 4,555,832 | A | * | 12/1985 | Sano et al. | 24/682 |
| 4,990,106 | A | | 2/1991 | Szegda | 439/585 |
| 5,470,257 | A | * | 11/1995 | Szegda | 439/578 |
| 5,791,919 | A | | 8/1998 | Brisson et al. | 439/166 |

* cited by examiner

*Primary Examiner*—P. Austin Bradley
*Assistant Examiner*—James R. Harvey
(74) *Attorney, Agent, or Firm*—Alfred N. Goodman; Jeffrey J. Howell

(57) ABSTRACT

An electrical connector for connecting an electrical cable to a conductive member having a first member electrically coupled to the electrical cable, a second member, and a threaded screw. The first member has a rod, a projection and a distal end and the second member has a threaded passageway, and two arms swaged around the rod and engaging the projection, allowing the first and second members to rotate relative to one another. The threaded screw engages the threaded passageway and can be threaded onto engagement with the projection, which in turn tightly engages the arms of the second member, thereby preventing relative rotation of the first member and the second member. Due to the large surface contact area, a low voltage drop occurs across the connector.

22 Claims, 3 Drawing Sheets

ROTATABLE AND LOCKABLE ELECTRICAL CONNECTOR

FIELD OF THE INVENTION

The present invention relates to an electrical connector that couples an electrically conductive cable to an electrically conductive stud, such as a bus bar, power supply, or a circuit board. The conductor has two separate members that freely rotate relative to each other when connecting to the stud. However, upon completing the connection to the stud, the two separate members are locked together and cannot rotate relative to each other.

BACKGROUND OF THE INVENTION

Connecting devices, such as nuts are commonly coupled to the ends of electrical cables and can freely rotate about a central axis. This type of connection allows an electrical cable to be connected to an electrical device without rotating the entire cable or the device to which the cable is connected.

Present day cable end connectors have axially rotating nuts connected to a tubular body. The tubular body is then crimped or soldered to an electrical cable. The nut is connected to the tubular body using two flanges, the first flange on the nut interconnecting with the second flange on the tubular body. This connection allows the nut to freely rotate relative to the tubular body and thus the cable. The nut has internal threads that engage external threads on the electrical device and can be tightened until the nut no longer rotates. However, it is possible to achieve the same connection and results by not locking the nut. This type of cable connector grounds the cable and results in high contact resistance and a relatively high voltage drop.

When connecting an electrical cable to an electrical device for power connection in a single voltage, single current configuration, it is desirable to have a low voltage drop, thus creating an efficient connector. A low voltage drop is possible by providing a connector with a relatively high electrically conductive mating surface area in the connection.

In addition, some cable connectors have multiple unattached parts. These parts are only interconnected when the connector is assembled and in use, attaching an electrical cable to an electrical device. Having multiple unattached parts may result in a connector that is difficult to assemble and the possibility of losing one part of the connector when in an unassembled configuration.

Examples of prior art electrical cable connectors are disclosed in the following U.S. Pat. No. : 1,039,542 to Kennington; U.S. Pat. No. 1,146,881 to Jeffries; U.S. Pat. No. 1,871,839 to Carter; U.S. Pat. No. 2,931,009 to Dutton et al.; U.S. Pat. No. 2,959,764 to Barr; U.S. Pat. No. 3,474,399 to Teagno; U.S. Pat. No. 4,990,106 to Szegda; and U.S. Pat. No. 5,791,919 to Brisson et al.

SUMMARY OF THE INVENTION

Accordingly, an object of the present invention is to provide an electrical end connector having a rotatable member that has few interconnected parts, resulting in a mated connector, and is relatively easy and inexpensive to manufacture and assemble.

Another object of the present invention is to provide an electrical end connector having a rotatable member that results in a low contact resistance and a low voltage drop across the connector, thereby making the connector highly efficient.

Still another object of the present invention is to provide an electrical end connector having a rotatable member that frictionally locks the rotatable member with a member attached to a cable, resulting in a linearly rigid connector.

The foregoing objects are basically attained by providing a cable end connector having a first member and a second member, the first member having an end engaged with an end of a cable and a rod having a projection connected to and adjacent to a second end, the second member having a first end with pair of opposed arms defining a slot therebetween, the rod of the first member being received within the slot and the arms being swaged around the rod, holding the second member onto the projection, while allowing the second member to freely rotate about the rod.

The foregoing objects are basically attained by providing an electrical cable end connector having a first member, a second member, and a threaded member, the first member being electrically coupled to the electrical cable and having a rod, a projection, and a distal end, the second member having a threaded passageway, and an arm swaged around the rod of the first member and engagable with the projection in the first member, the threaded member being electrically coupled to the conductive member, and threadedly received in the threaded passageway, the threaded member tightly engaging the distal end of the first member, thereby causing the arm to tightly engage the projection in the first member, preventing relative rotation of the first member and the second member.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

Referring to the drawings which form a part of this disclosure.

DETAILED DESCRIPTION OF THE PREFERRED EMBODIMENT

Figure 1:
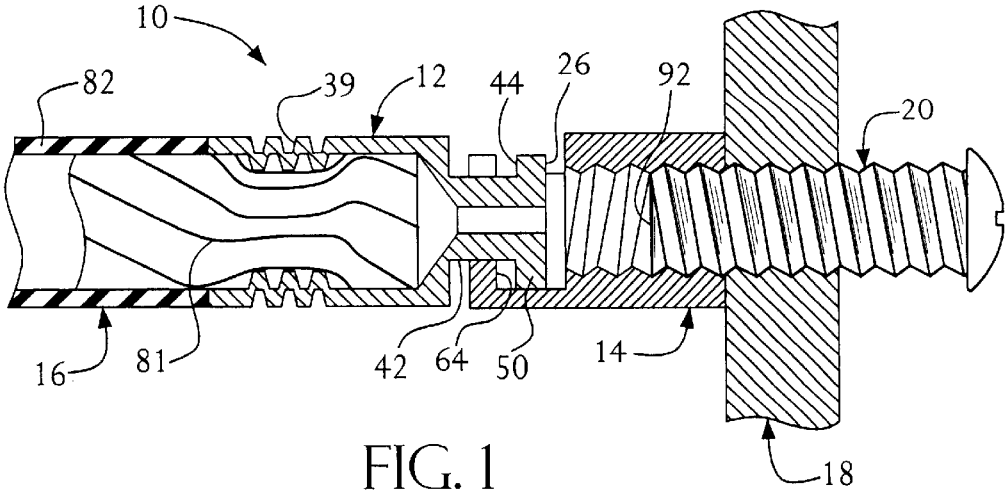
FIG. 1 is a cross sectional side view of an electrical end connector in accordance with the present invention, illustrating the connector with the second member in a freely rotatable position.

Referring initially to FIGS. 1–4, an electrical end connector 10 according to the present invention is formed from a first member 12 electrically interconnected with a second member or nut 14. Electrical cable 16 is crimped to first member 12 and stud 18 is electrically connected to second member 14 by threaded member 20.

Figure 4:
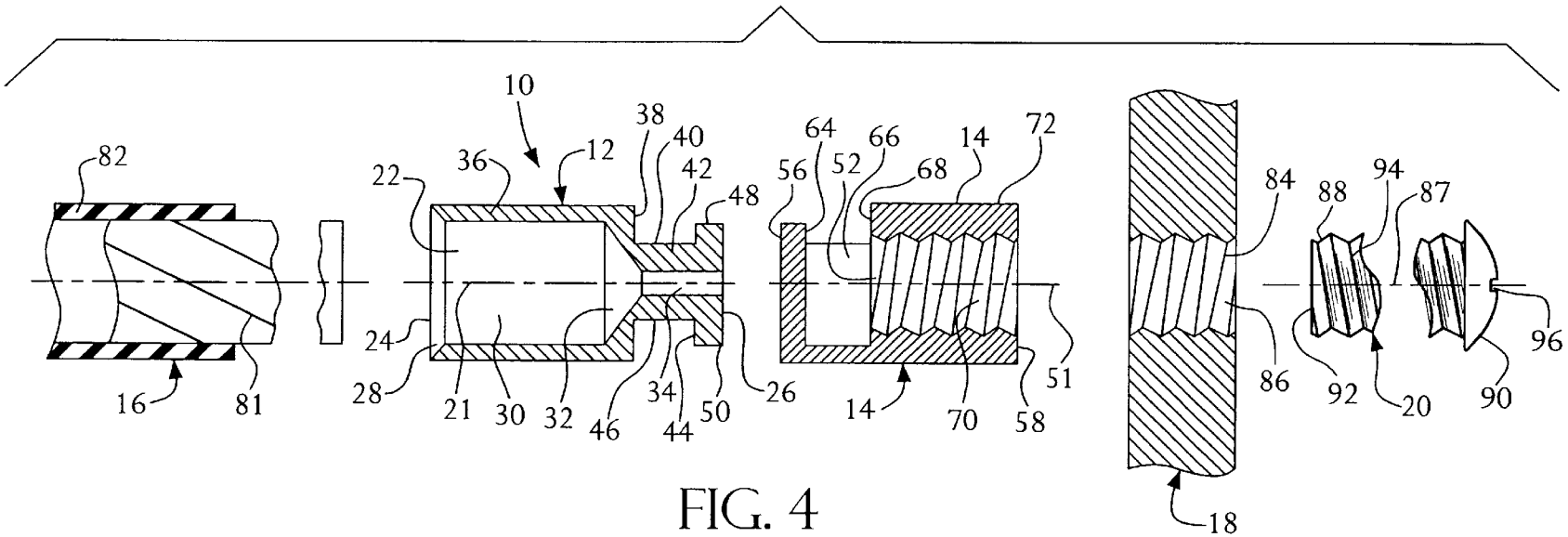
FIG. 4 is an exploded cross sectional side view of the electrical end connector illustrated in FIG. 1.

First member 12 is advantageously formed of an electrically conductive metal, such as aluminum, has a longitudinal axis 21, a through passageway 22 along the longitudinal axis;, first open end 24 and second open end or distal end 26. First open end 24 is at the rear or trailing end of the member and second open end 26 is at the front or leading end of the member. As seen in FIG. 4, adjacent first open end 24 is an interior frustoconical surface 28 tapering inward, which extends into interior cylindrical surface 30. Surface 30 extends substantially the entire interior length of member 12 and is adjacent to interior inwardly tapering frustoconical surface 32. Surface 32 extends into interior cylindrical surface 34, which has a smaller diameter than cylindrical surface 30. Surface 34 extends from frustoconical surface 32 to second opened end 26 and forms the opening in end 26.

Figure 2:
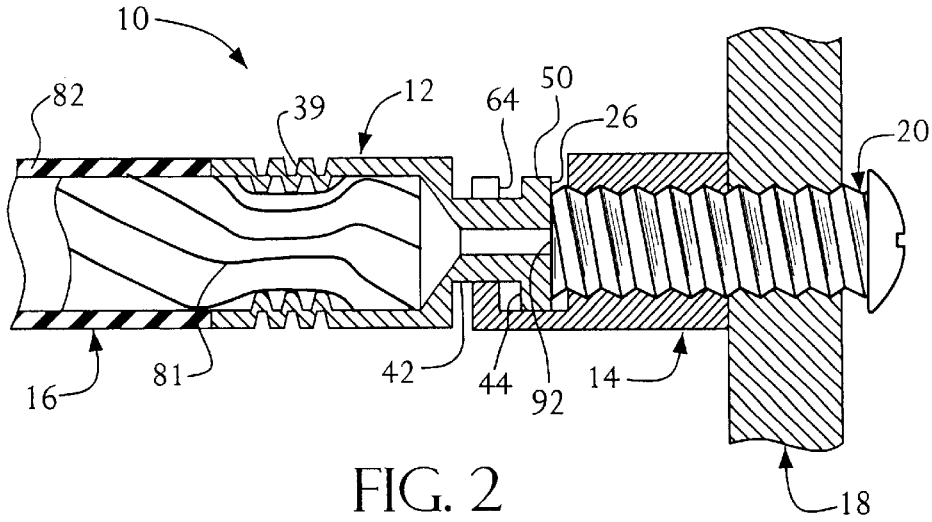
FIG. 2 is a cross sectional side view of the electrical end connector illustrated in FIG. 1 with the threaded screw engaging the first member.
Figure 3:
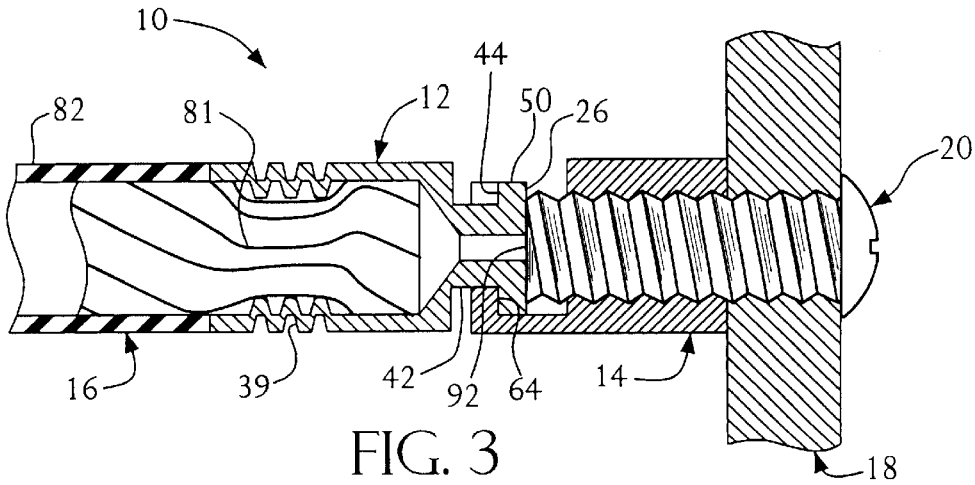
FIG. 3 is a cross sectional side view of the electrical end connector illustrated in FIG. 1 with the first and second members in a frictionally locked, nonrotable position.

The exterior of member 12 is substantially cylindrical and forms a tubular body 36 with a radially inwardly axial facing annular surface 38. Although member 12 is substantially cylindrical, when coupled to wire 16, member 12 is fixedly attached to the wire by crimps 39, as seen in FIGS. 1–3. Adjacent surface 38 is a radially outwardly facing annular surface 40, forming rod 42, as seen in FIG. 4. Rearwardly axially facing annular surface 44, along with surfaces 38 and 40 form an annular groove 46 around member 12. Adjacent annular groove 46 is radially outwardly facing annular surface 48, terminating at second end 26. Second end 26 is an axially facing surface and is substantially flat and circular. The combination of surfaces 44 and 48 and second end 26 form cylindrical projection 50.

Figure 5:
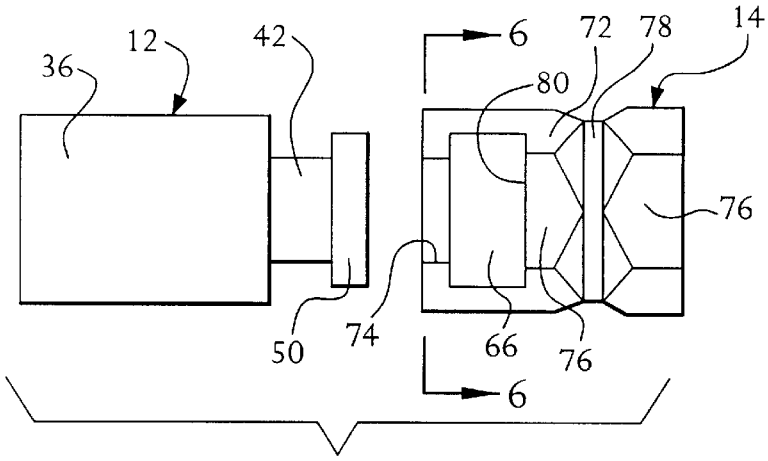
FIG. 5 is an exploded elevational side view of the first and second members of the electrical end connector illustrated in FIG. 1
Figure 6:
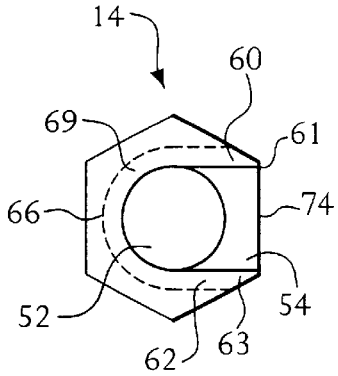
FIG. 6 is an elevational end view of the second member taken along line 6—6 of FIG.5.
Figure 7:
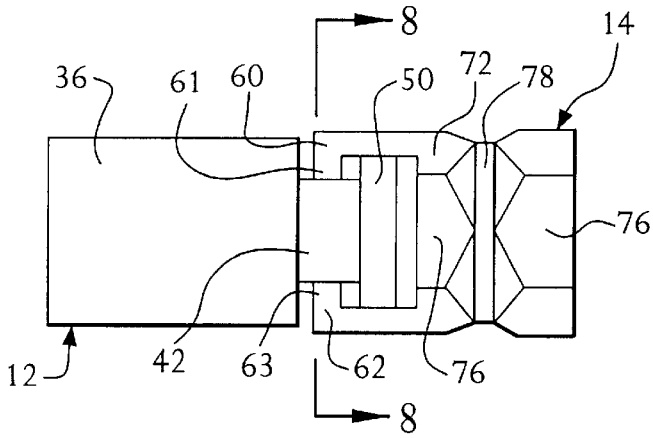
FIG. 7 is an elevational side view of the first and second members of the electrical end connector illustrated in FIG. 1 assembled but unswaged.
Figure 8:
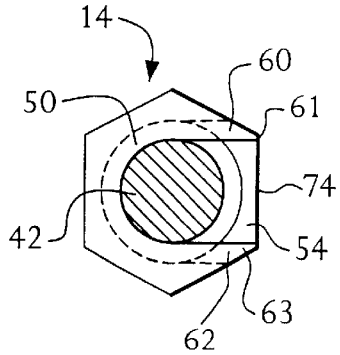
FIG. 8 is a cross sectional end view in section of the first and second members in the unswaged configuration taken along line 8—8 of FIG. 7.

Second member 14 is advantageously formed of an electrically conductive metal, such aluminum, has a longitudinal axis 51, a through passageway 52 along the longitudinal axis and first and second open ends 56 and 58. First open end 56 is at the rear or trailing end of the member and second open end 58 is at the front or leading end of the member. As seen in FIGS. 4–6, first end 54 has a U-shaped slot or cutout 54, formed from arms 60 and 62. Arms 60 and 62 also define an interior forwardly axial facing surface 64. Adjacent surface 64, member 14 has a radially inwardly facing U-shaped surface 66. Along with interior rearwardly axially facing annular surface 68, surfaces 64 and 66 define an annular groove 69. Internal threads 70 extend from surface 68 to second open end 58, and create the opening in second end 58.

As seen in FIGS. 4–6, the exterior of member 14 is generally octagonal and forms a tubular body 72. First open end 56 is substantially flat with arms 60 and 62 having ends 61 and 63. Arms 60 and 62 define U-shaped slot 54 with a radial opening 74 in one of the octagonal sides of tubular body 72. Between the ends 56 and 58 of the second member are a series of preferably two sets of eight external flats 76 separated by radial outwardly facing annular groove 78. Flats 76 allow tubular body 72 to be gripped and rotated as necessary via a suitable tool such as a wrench. Member 14 may have any number of external flats that allow the tubular body to be gripped and rotated by a suitable tool. Opening 80 is formed through the wall of the tubular member from the outer surface to the inner surface with its longer side substantially perpendicular to longitudinal axis 21 and it extends approximately the length of two of the eight external flats. Opening 80 is wider than radial opening 74 and is adjacent to and integrally formed with opening 74, forming one T-shaped opening, as seen in FIG. 5. Openings 74 and 80 may be any size, as long as opening 80 is wider than opening 74. Second open end 58 is substantially flat and octagonal.

Electrical cable 16 is preferably seven large gauge to 100 small gauge individual copper wires 81 intertwined, forming one cable, surrounded by insulator 82. However, cable 16 may be any conductive metal with any number of individual wires, as long as the metal is capable of high voltage power transfer.

Stud or conductive member 18 can be formed from any conductive metal and has a through passageway 84 with internal threads 86 that are substantially similar in size and diameter as internal threads 70 in second member 14. Stud 18 can be any device cable of producing or receiving power such as a bus bar, a power supply, a switching power supply, a printed circuit board, or the like.

Threaded member 20 is preferably formed from an electrically conductive metal, such as brass and has a longitudinal axis 87 with first and second ends 88 and 90. End 88 has an axially facing annular surface 92 that is substantially circular and flat. Threaded member 20 has external threads 94 extending between ends 88 and 90 that may engage internal threads 70 and 86. Second end 90 has a groove 96 so that the threaded member can be engaged and rotated as necessary via a suitable tool such as a screwdriver. It is not necessary for threaded member 20 to be a screw, as seen in FIGS. 1–4, and may be any threaded device such as a bolt, or the like.

Assembly

As seen in FIGS. 5–8, rod 42 and projection 50 are slidably received in radial opening 74 and opening 80, respectively. Rod 42 is situated in U-shaped slot 54 between arms 60 and 62. Projection 50 is situated in annular groove 69, with rearward axial facing surface 44 adjacent forward axial facing surface 64 and second end 26 adjacent rearward axial facing surface 68. This configuration prevents most radial movement, other than movement through openings 74 and 80, while allowing first and second members to rotate relative to each other.

Figure 9:
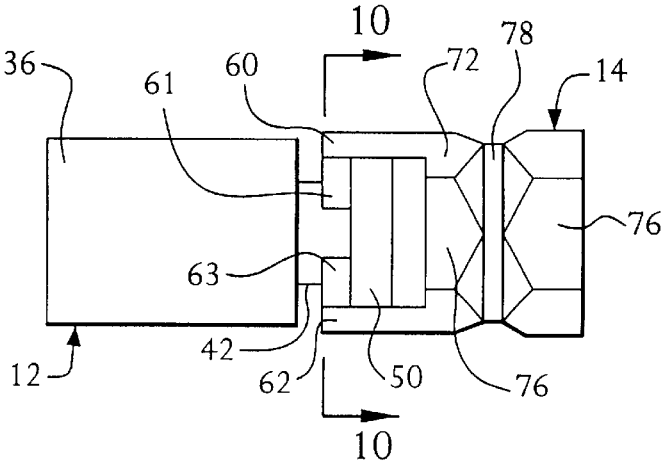
FIG. 9 is a elevational side view of the first and second members of the electrical end connector illustrated in FIG. 1 assembled and swaged.
Figure 10:
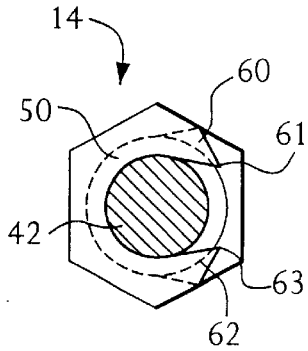
FIG. 10 is a cross sectional end view in section of the first and second members in the swaged configuration taken along line 10—10 of FIG. 9.

As seen in FIGS. 9 and 10, arms 60 and 62 are then swaged towards one another from a substantially tangential and parallel position with a swaging tool around rod 42 and into annular groove 46. In the final swaged position, the opposed arms 60 and 62 form an angle of about 35 degrees. By swaging arms 60 and 62, the distance between the ends 61 and 63 is reduced and is less than the diameter of rod 42. If the arms are swaged the proper amount, the first member and the second member are coupled together with substantially no radial movement. However, the first and second members are still able to freely rotate on longitudinal axis 51 relative to each other. Thus, allowing second member 14 to rotate and thread onto threaded member 20, while first member 12 is axially stationary relative to cable 16.

As seen in FIGS. 1–4, first member 12 may then be coupled to cable 16. Insulator 82 must be stripped from cable 16, revealing copper wires 81 approximately the same length as surface 30. Wires 81 are then coupled to first member 12 via a crimping tool. It is preferred to use three to eight crimps, but any number capable of securely holding cable 16 and first member 12 together would be acceptable.

Insulation may then be applied at the connecting point between first member 12 and cable 16 to further enhance safety.

Threaded member 20 is then received in through passageway 84 and threads 94 of threaded member 20 engage internal threads 86 of stud 18. Second member 14 is then aligned so that through passageway 52 is aligned with through passageway 84. Threaded member is threaded into stud 18 until threaded member 20 is received in through passageway 52 and external threads 94 engage internal threads 70.

Operation

As seen in FIGS. 1–3, threaded member 20 is threaded into second member 14 and axially facing surface 92 contacts second end 26 of first member 12 and applies pressure to second end 26. This pressure forces rearwardly axial facing annular surface 44 of the first member to contact forwardly facing surface 64 of second member 14. A s threaded member 20 is tightened against second end 26, annular surface 44 is tightened against surface 64, frictionally locking second end 26 with surface 64, thus locking first member 12 with second member 14 and preventing relative rotation therebetween and forming a linearly rigid connector.

By forming a locking electrical end connector as described a more efficient high current power connection is achieved. As described above, in a single voltage, single current configuration, it is desirable to have a low voltage drop. This is possible by providing a connector with as much electrically conductive surface area as possible in the connection. In the present invention, by forming the connector from electrically conductive metals and having second end 26 substantially circular and flat and contacting forwardly facing surface 64, there is a relatively high surface area capable of conducting the electricity. In addition, the threads of the electrically conductive threaded member create an additional contact surface. These surfaces taken in combination create a connector that has a relatively high electrically conductive surface area, which results in low contact resistance and therefore a low voltage drop across the connector. Additionally, this high contact surface area allows the connector to perform as desired even if the threaded member is off by a turn, therefore not completely frictionally locking the first and the second members.

The connector allows first and second members 12 and 14 to rotate relative to each other when not tightly engaged with the threaded member 20. This rotation allows second member 14 to threadly engage a threaded member and rotate about longitudinal axis 51, thereby tightening the threaded member against second end 26, while first member 12 is coupled to an electrical cable. In this configuration, the first member and therefore the cable do not have to be rotated to connect the electrical cable to output stud 18, and a linearly rigid connector that resists counter torque loosening is formed.

Furthermore first member 12 and second member 14 are coupled together by the swaged arms 60 and 62, forming a connector that is easy to manufacture and assemble but difficult to separate.

While a particular embodiment has been chosen to illustrate the invention, it will be understood by those skilled in the art that various changes and modifications can be made therein without departing from the scope of the invention as defined in the appended claims.

What is claimed is:

1. A cable end corrector comprising:

a first member having a first end engaged with an end of a cable, said first member having a rod adjacent a second end, and a projection adjacent said rod; and a second member having a pair of opposed arms defining a slot therebetween at a first end, said slot receiving said rod, and said pair of opposed arms swaged around said rod, thereby holding said second member onto said projection, while allowing said second member to freely rotate about said rod.

2. A cable end connector according to claim 1, wherein said slot is substantially U-shaped.

3. A cable end connector according to claim 1, wherein said projection is substantially cylindrical.

4. A cable end connector according to claim 3, wherein said projection has first and second axially facing surfaces.

5. A cable end connector according to claim 4, wherein said second axially facing surface of said projection is substantially flat and circular.

6. A cable end connector according to claim 5, wherein said second member has an interior annular groove adjacent said slot and has first and second axially facing surfaces for receiving said projection.

7. A cable end connector according to claim 6, wherein said second member has a second end with internal threads.

8. A cable end connector according to claim 7, further comprising a screw having an axially facing surface and external threads engaging said internal threads, said axially facing surface engaging said second axially facing surface of said projection when said screw is threaded into said second member and applying pressure to said second axially facing surface of said projection, thereby forcing said first axially facing surface of said projection to contact said first axially facing surface of said second member and thereby preventing relative rotation of said first member and said second member when said second axially facing surface of said projection and said axially facing surface of said screw are frictionally engaged.

9. A cable end connector according to claim 8, wherein said screw is coupled to a bus bar, switched power supply, or circuit board.

10. An electrical connector for connecting an electrical cable to a conductive member, comprising:

a first member electrically coupled to the electrical cable and having a rod a projection and a distal end;

a second member having a threaded passageway, and an arm swaged around said rod in said first member and engagable with said projection in said first member; and a threaded member, electrically coupled to the conductive member, and threadedly received in said threaded passageway, wherein, when said threaded member tightly engages said distal end of said first member, said arm tightly engages said projection in said first member, thereby preventing relative rotation of said first member and said second member.

11. An electrical connector according to claim 10, wherein said projection is substantially cylindrical.

12. An electrical connector according to claim 11, wherein said distal end of said first member is substantially flat and circular.

13. An electrical connector according to claim 12, wherein said arm of said second member defines a slot that receives said rod.

14. An electrical connector according to claim 13, wherein said slot is substantially U-shaped.

15. An electrical connector according to claim 14, wherein said second member has first and second axially facing surfaces that define an interior annular groove for receiving said projection.

16. A cable end connector according to claim 10, wherein said threaded member is coupled to a bus bar, switched power supply, or circuit board.

17. A cable end connector, comprising:

a tubular first member having a central longitudinal axis, a through passageway extending along said longitudinal axis, a first end adapted to engage an end of a cable, a rod adjacent a second end, and a cylindrical projection having first and second axially facing surfaces;

a tubular second member having a first end with a pair of arms defining a slot receiving said rod, first and second axially facing surfaces for receiving said projection, and a second end with internal threads;

said arms swaged around said rod and holding said tubular second member to said tubular first member; and a screw having an axially facing surface and external threads engaging said internal threads;

wherein said axially facing surface of said screw engages said first axially facing surface of said projection when said screw is threaded into said second member and applies pressure to said first axially facing surface of said projection, thereby forcing said second axially facing surface of said projection to contact said first axially facing surface of said second member and preventing relative rotation of said first member and said second member.

18. A cable end connector according to claim 17, wherein said second axially facing surface of said projection is substantially flat and circular.

19. A n cable end connector according to claim 17, wherein said slot is substantially U-shaped.

20. A cable end connector according to claim 19, wherein said screw is coupled to a bus bar, switched power supply, or circuit board.

21. An electrical connector for connecting an electrical cable to a conductive member, the combination comprising:

a first member electrically coupled to the electrical cable and having a rod, a projection and a distal end;

a second member having a passageway, and an arm that extends around said rod of said first member and engagable with said projection of said first member; and a third member, electrically coupled to the conductive member, and received in said passageway, wherein, when said third member tightly engages said distal end of said first member, said arm tightly engages said projection of said first member, thereby preventing relative rotation of said first member and said second member.

22. A cable end connector, comprising:

a tubular first member having a central longitudinal axis, a through passageway extending along said longitudinal axis, a first end adapted to engage an end of a cable, a rod adjacent a second end, and a cylindrical projection having first and second axially facing surfaces;

a tubular second member having a first end with a pair of arms defining a slot receiving said rod, first and second axially facing surfaces for receiving said projection, a second end and a through passageway;

said arms extending around said rod and holding said tubular second member to said tubular first member; and a third member having an axially facing surface adapted to at least partially enter said through passageway;

wherein said axially facing surface of said third member engages said first axially facing surface of said projection when said third member enters said through passageway and applies pressure to said first axially facing surface of said projection, thereby forcing said second axially facing surface of said projection to contact said first axially facing surface of said second member and preventing relative rotation of said first member and said second member.

* * * * *